US007430970B2

(12) United States Patent
LaRue et al.

(10) Patent No.: US 7,430,970 B2
(45) Date of Patent: Oct. 7, 2008

(54) BURNER WITH CENTER AIR JET

(76) Inventors: Albert D. LaRue, 3933 Meadow Wood La., Uniontown, OH (US) 44685; Alan N. Sayre, 2457 W. Bent Oak Cir., North Canton, OH (US) 44720; William J. Kahle, 6885 Milhaven Ave. NW., Canal Fulton, OH (US) 44614; Hamid Sarv, 2958 Millridge Cir., NW., Canton, OH (US) 44708; Daniel R. Rowley, 2449 Pleasant Pl., Alliance, OH (US) 44601

( * ) Notice: Subject to any disclaimer, the term of this patent is extended or adjusted under 35 U.S.C. 154(b) by 340 days.

(21) Appl. No.: 11/171,027

(22) Filed: Jun. 30, 2005

(65) Prior Publication Data

US 2007/0003889 A1 Jan. 4, 2007

(51) Int. Cl.
*F23D 1/00* (2006.01)
*F23D 1/04* (2006.01)

(52) U.S. Cl. ..... 110/347; 110/261; 431/8; 431/9; 431/10; 431/182; 431/183; 431/187; 431/188

(58) Field of Classification Search ..... 431/8, 431/9, 10, 115, 182, 183, 184, 187, 188, 431/350; 110/260–262, 347
See application file for complete search history.

(56) References Cited

U.S. PATENT DOCUMENTS 1,708,498 A * 4/1929 Ehrhardt, Jr. ..... 52/272
1,805,066 A * 5/1931 Andrieux ..... 431/8
1,995,934 A * 3/1935 Mangold ..... 239/416.5
3,822,654 A * 7/1974 Ghelfi ..... 110/260
4,023,921 A * 5/1977 Anson ..... 431/9
4,147,116 A * 4/1979 Graybill ..... 110/263
4,333,405 A * 6/1982 Michelfelder et al. ..... 110/264
4,348,168 A * 9/1982 Coulon ..... 431/9
4,367,686 A * 1/1983 Adrian ..... 110/347
4,422,389 A * 12/1983 Schroder ..... 110/264
4,422,391 A * 12/1983 Izuha et al. ..... 110/347
4,551,090 A * 11/1985 Leikert et al. ..... 431/188
4,556,384 A * 12/1985 Laurenceau et al. ..... 431/160
4,622,007 A * 11/1986 Gitman ..... 432/13
4,626,195 A * 12/1986 Sato et al. ..... 431/188
4,748,919 A * 6/1988 Campobenedetto et al. . 110/264
4,797,087 A * 1/1989 Gitman ..... 431/10
4,930,430 A * 6/1990 Allen et al. ..... 110/264
4,933,163 A * 6/1990 Fischer et al. ..... 423/574.1
5,199,355 A 4/1993 LaRue
5,231,937 A * 8/1993 Kobayashi et al. ..... 110/262
5,411,394 A * 5/1995 Beer et al. ..... 431/9
5,597,298 A * 1/1997 Snyder et al. ..... 431/8
5,649,494 A * 7/1997 Hufton ..... 110/262
5,651,320 A * 7/1997 Leisse et al. ..... 110/262
5,697,306 A * 12/1997 LaRue et al. ..... 110/261
5,743,723 A * 4/1998 Iatrides et al. ..... 431/8

(Continued)

*Primary Examiner*—Carl D Price
(74) *Attorney, Agent, or Firm*—Michael J. Seymour; Eric Marich

(57) ABSTRACT

A new burner apparatus and method of combusting fossils fuels for commercial and industrial application is provided wherein the new burner apparatus achieves low $NO_x$ emissions by supplying oxygen to the center of the burner flame in as manners so as to create a fuel rich internal combustion zone within the burner flame.

26 Claims, 4 Drawing Sheets

U.S. PATENT DOCUMENTS 5,829,369 A * 11/1998 Sivy et al. ..... 110/347
5,878,676 A * 3/1999 Jochem et al. ..... 110/261
5,979,342 A * 11/1999 Leisse et al. ..... 110/264
6,244,860 B1 * 6/2001 Gross et al. ..... 432/219
6,699,030 B2 * 3/2004 Bool et al. ..... 431/10
6,807,914 B2 * 10/2004 Leisse et al. ..... 110/106
6,939,125 B2 * 9/2005 Yokotani et al. ..... 431/5

* cited by examiner

BURNER WITH CENTER AIR JET

FIELD OF THE INVENTION

The present invention relates generally to fuel burners and, in particular, to a new and useful pulverized coal burner and method of combustion which achieves low $NO_x$ emissions by supplying oxygen directly to the center of the burner flame in a manner so as to create a fuel rich internal combustion zone within the burner flame and accelerate fuel combustion.

BACKGROUND OF THE INVENTION $NO_x$ is a byproduct produced during the combustion of coal and other fossil fuels. Environmental concerns regarding the effects of $NO_x$ have prompted enactment of $NO_x$ emissions regulations requiring sharp $NO_x$ emission reductions from industrial and utility power plants in several countries including the United States. Current commercial methods and apparatuses for reducing $NO_x$ emissions have been successful in lowering $NO_x$ emissions from the levels emitted in previous years; however, further advances, beyond those of currently known methods and apparatuses, are needed to maintain compliance with current $NO_x$ emissions regulations.

A variety of low $NO_x$ burners are commercially available and widely used to fire pulverized coal (PC) and other fossil fuels in a $NO_x$ reducing manner as compared to conventional burners. Examples of such burners are The Babcock & Wilcox Company's DRB-XCL® and DRB-4Z® burners. Common to these and other low $NO_x$ burner designs is an axial coal nozzle surrounded by multiple air zones which supply secondary air (SA). During operation, PC suspended in a primary air (PA) stream, is injected into the furnace through an axial coal nozzle, as an axial jet, with little or no radial deflection. Ignition of the PC is accomplished by swirling SA, thereby causing recirculation of hot gases along the incoming fuel jet.

Typically a fraction of the SA is supplied to an air zone in close proximity to the coal nozzle and swirled to a relatively greater extent than the SA supplied to the other air zones to accomplish ignition. The remaining SA from the burner is introduced through air zones further outboard in the burner utilizing less swirl, so as to mix slowly into the burner flame, thereby providing fuel rich conditions in the root of the flame. Such conditions promote the generation of hydrocarbons which compete for available oxygen and serve to destroy $NO_x$ and/or inhibit the oxidation of fuel-bound and molecular nitrogen to $NO_x$.

$NO_x$ emissions can further be reduced by staged combustion, wherein the burner is provided with less than stoichiometric oxygen for complete combustion. A fuel rich environment results at the burner flame. The fuel rich environment inhibits $NO_x$ formation by forcing $NO_x$ precursors to compete with uncombusted fuel in an oxygen lean environment. Combustion is then staged by providing excess oxygen to the boiler at a point above the burner wherein the excess fuel combusts at a lower temperature, thus precluding the production of thermal $NO_x$ as the combustion occurs at a lower temperature away from the burner flame. Staging also serves to lessen oxygen concentrations during the combustion process which inhibits oxidation of fuel bound nitrogen (fuel $NO_x$).

Oxygen for staged combustion is normally provided in the form of air via air staging ports, commonly called Over Fire Air (OFA) ports, in a system utilizing low $NO_x$ burners. U.S. Pat. No. 5,697,306 to LaRue, and U.S. Pat. No. 5,199,355 to LaRue, herein incorporated by reference, disclose low $NO_x$ burners that may be combined with air staged combustion methods to further reduce $NO_x$ emissions.

Unlike conventional burners, low $NO_x$ burners tend to form long flames and produce higher levels of unburned combustibles. Long flames are not always desirable as they may be incompatible with furnace depth or height, and can impair boiler operation by causing flame impingement, slagging, and/or boiler tube corrosion.

Long flames result from an insufficient air supply to the fuel jet as it proceeds into the furnace. SA from the outer air zones of low $NO_x$ burners do not effectively penetrate the downstream fuel jet, such that unburned fuel persists due to a lack of air supply along the flame axis. High levels of unburned fuel are undesirable in both furnaces with OFA and those without. Unburned combustibles in the form of unburned carbon and CO reduce boiler efficiency and add operation expenses, whereas unburned pulverized coal, by nature of its abrasiveness, may cause undesirable erosive damage to the furnace itself.

Incomplete air/fuel mixing ahead of an OFA system can cause excessive amounts of unburned fuel to persist up to the OFA ports. When large amounts of unburned fuel try to burn with air at the OFA zone, $NO_x$ formation can increase, thereby minimizing or negating the benefit of staged combustion with OFA. In addition it becomes increasingly difficult to completely burn out these combustibles at and beyond the OFA ports, such that they add to inefficiency and operational difficulties.

SUMMARY OF THE INVENTION

The present invention solves the aforementioned problems associated with delayed combustion produced by typical low $NO_x$ burners and introduces a new burner apparatus and method of combusting fossil fuels to further reduce $NO_x$ emissions in commercial and utility boilers.

A burner according to the present invention is suitable for firing pulverized coal (PC) or gaseous hydrocarbons. The present invention comprises an axial zone concentrically surrounded by a first annular zone. The first annular zone provides fuel to the burner at a predetermined velocity so as to create a fuel jet exiting the burner and subsequently forming a burner flame via combustion in the presence of oxygen. The axial zone produces a center air jet piercing the burner flame along its internal axis. The center air jet provides oxygen along the center axis of the burner flame, allowing the flame to combust from the inside out, while maintaining an overall fuel rich environment in the flame root thereby suppressing $NO_x$ formation.

Additional oxygen supplied by second and third annular zones concentrically surrounding the first annular zone further reduces $NO_x$ formation while providing a means for accelerating combustion. Flow conditioning devices of the second and third annular zones aerodynamically suppress fuel jet expansion. Within this aerodynamic suppression, swirl from the air exiting the second and third annular zones creates an internal recirculation zone along the outer boundary of the flame zone which inhibits $NO_x$ formation. The internal recirculation zone (IRZ) causes $NO_x$ formed along the outer air-rich periphery of the flame to recirculate back into the fuel rich flame core. The hotter flame temperature, resulting from the inside out combustion of the center air jet, cause uncombusted hydrocarbon radicals to scavenge available oxygen within the IRZ, thereby suppressing the formation of $NO_x$, and reducing NO back to other nitrogenous species. A wider, shorter flame envelope results as flame temperature increases due to the accelerated combustion of fuel from the inside out and outside in within the IRZ.

Another aspect of the present invention can be considered a method of reducing $NO_x$ emissions in a center air jet burner comprising, providing a burner having an axial zone concentrically surrounded by a first annular zone, providing the axial zone with a first gas comprising oxygen, wherein the first gas exits the axial zone at a velocity between about 5000 ft/min and about 10,000 ft/min, providing the first annular zone with a carrier gas comprising a pulverized coal, wherein the carrier gas exits the axial zone at a velocity between about 3000 ft/min and about 5000 ft/min.

Yet another aspect of the present invention can be considered a method of reducing $NO_x$ emissions in a center air jet burner comprising, providing a four zone burner, wherein the innermost zone is an axial zone concentrically surrounded by a first annular zone, which in turn is concentrically surrounded by a second annular zone, which in turn is concentrically surrounded by a third annular zone, providing the axial zone with a first gas comprising oxygen, providing the first annular zone with a carrier gas comprising a pulverized coal, providing the second annular zone with a second gas comprising oxygen, providing the third annular zone with a third gas comprising oxygen, providing the burner with the carrier gas at a velocity greater than about 3000 ft/min, providing the burner with the first gas at a velocity greater than the carrier gas, providing the burner with the second gas at a velocity less than the carrier gas, providing the burner with the third gas at a velocity greater than the carrier gas, combusting the pulverized coal in the carrier gas stream from the inside of the stream with the first gas, combusting the pulverized coal in the carrier gas stream from the outside with the second gas and the third gas, utilizing the velocity gradient between the four annular zones to create a recirculation zone within a burner flame, suppressing NOx formation and accelerating combustion by recirculation of uncombusted coal and oxygen in the burner flame.

The various features of novelty which characterize the present invention are pointed out with particularity in the claims annexed to and forming a part of this disclosure. For a better understanding of the invention, it's operating advantages and specific benefits attained by it's uses, reference is made to the accompanying drawings and descriptive matter in which the preferred embodiments of the invention are illustrated.

DESCRIPTION OF THE PREFERRED EMBODIMENTS

Figure 1:
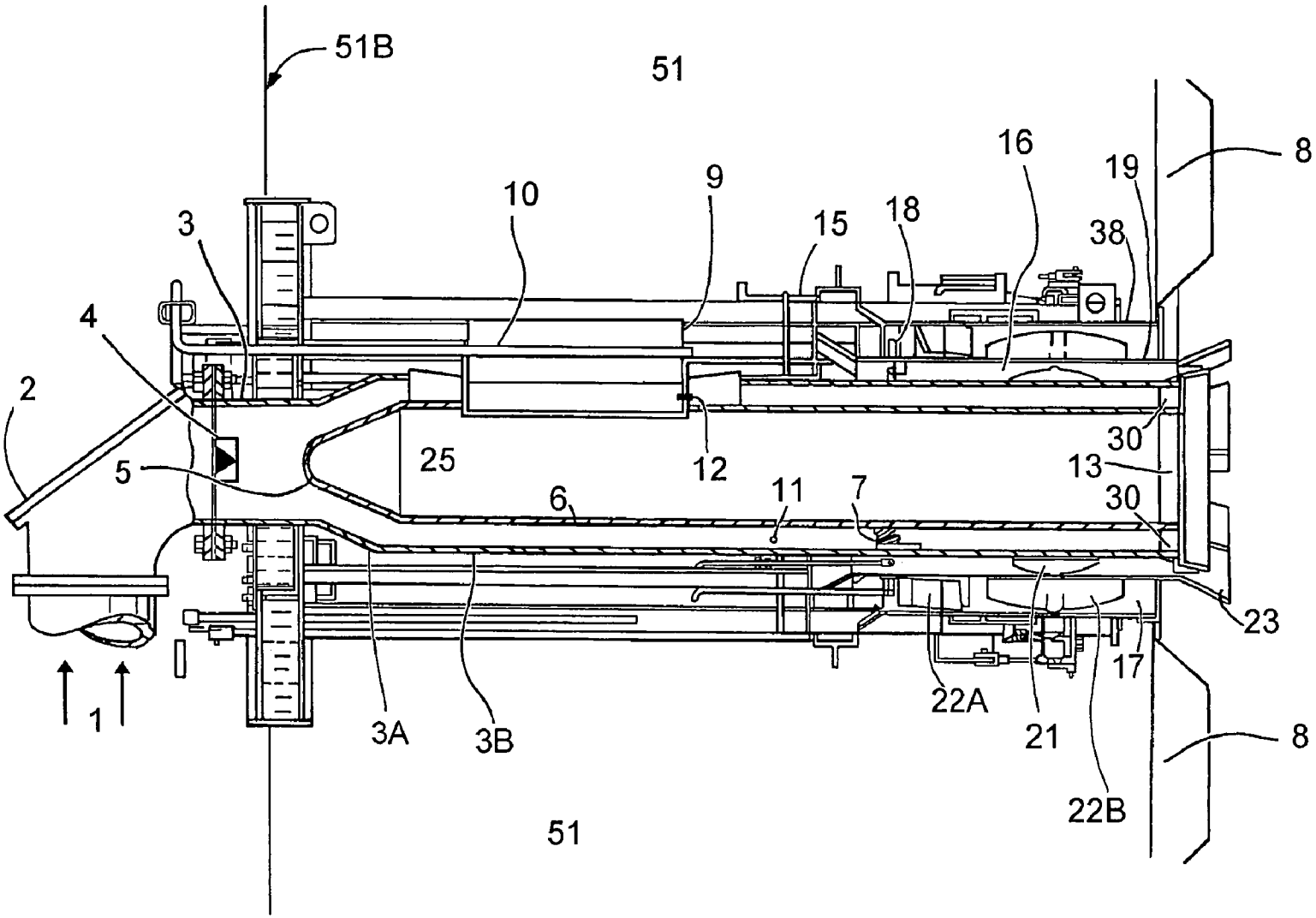
FIG. 1 is a schematic sectional view of an embodiment of the present invention.

Referring to the drawings, generally where like numerals designate the same or functionally similar features, throughout the several views and first to FIG. 1, there is shown a schematic sectional view of a burner depicted in accordance with the present invention. Axial pipe 6, defining an axial zone 25 therein, is concentrically surrounded by a first annular pipe 3 wherein the area between the two pipes defines a first annular zone 11. Radially interposed between a portion of first annular pipe 3 and axial pipe 6 is feeder duct 9 such that axial pipe 6 and windbox 51 are in fluid communication with opposite ends of feeder duct 9.

Figure 3:
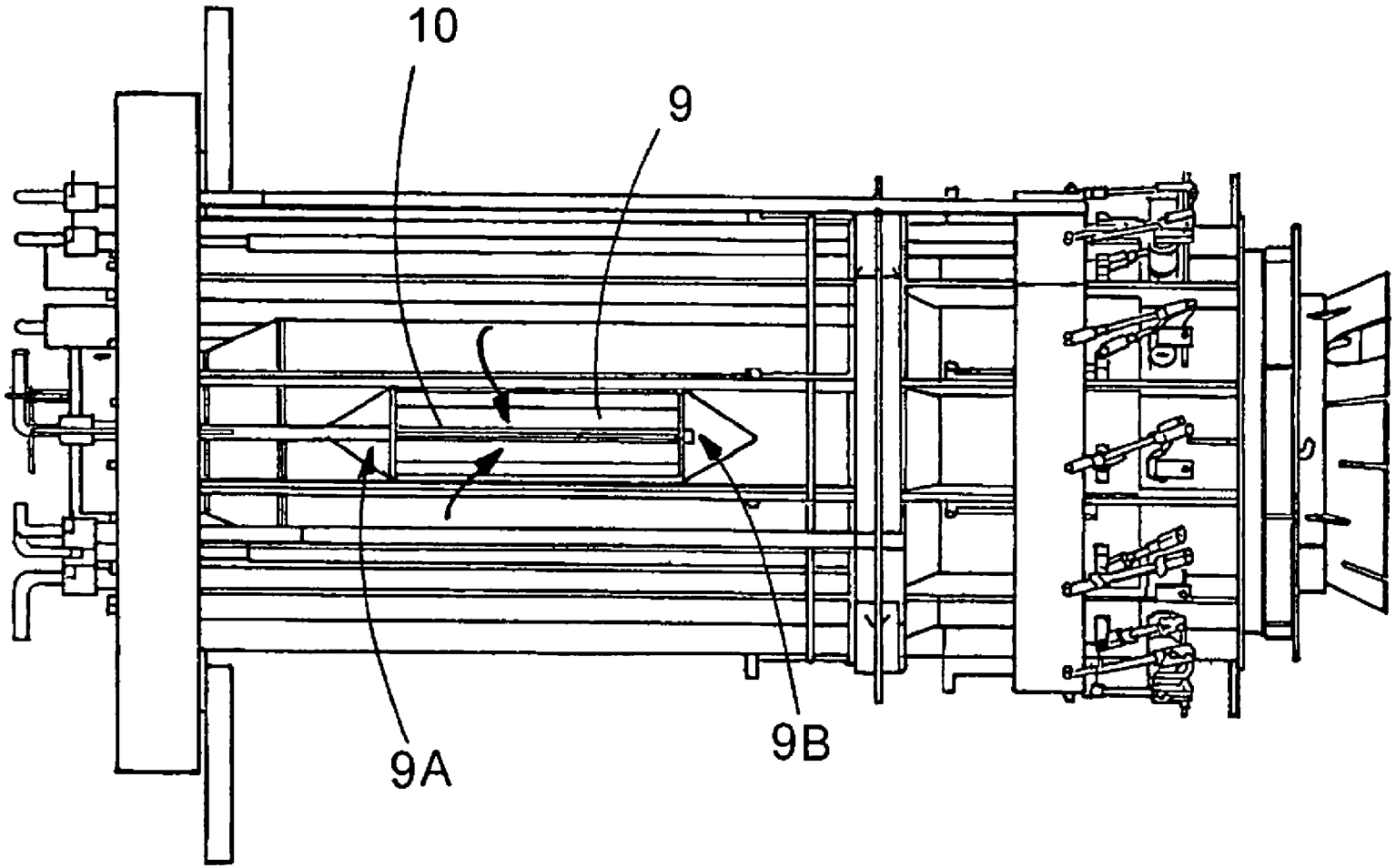
FIG. 3 is a outside view of a burner assembly embodiment of the present invention identifying the location of feeding duct 9.
Figure 4:
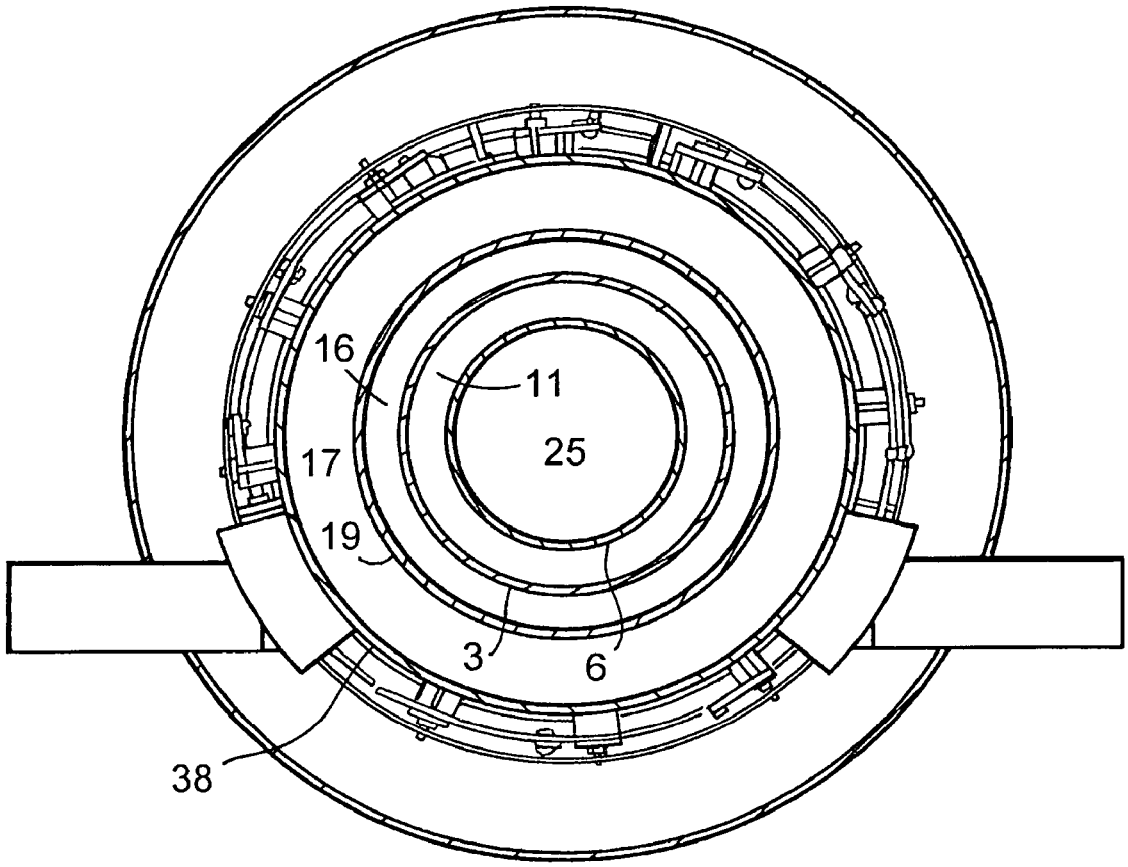
FIG. 4 is a schematic cross sectional view of an embodiment of the present invention which identifies the concentric zones of the present invention.

Referring now to FIG. 3, a top view of feeder duct 9 radially interposed between at least a portion of first annular pipe 3 and axial pipe 6 (not shown in FIG. 3) is provided, such that axial pipe 6 and windbox 51 are in fluid communication with opposite ends of feeder duct 9.

Referring back to FIG. 1, secondary air is supplied by forced draft fans (not shown), preheated in air heaters (not shown), and under pressure to windbox 51. Feeder duct 9 in turn provides secondary air from windbox 51 to axial pipe 6, at a rate controlled by damper 10. An air flow measuring device 12 quantifies the secondary air flowing through feeder duct 9.

A pulverizer (not shown) grinds coal which is conveyed with primary air through a conduit connected to a burner elbow 2. An igniter (not shown) may be positioned on the axis of the burner, penetrating elbow 2, plug 5, and extending through axial pipe 6.

Pulverized coal and primary air (PA/PC) 1 pass through the burner elbow 2. The pulverized coal generally travels along the outer radius of elbow 2 and concentrates into a stream along the outer radius at the elbow exit. The pulverized coal enters first annular zone 11 and encounters a deflector 4 which redirects the coal stream into plug 5 and disperses the coal. Axial pipe 6 is attached to the downstream side of plug 5. First annular pipe 3 expands in section 3A to form a larger diameter section 3B. The dispersed coal travels along first annular zone 11 wherein bars and chevrons 7 provide more uniform distribution of the pulverized coal before exiting the first annular zone 11 as a fuel jet. Wedged shaped pieces 9A and 9B (FIG. 3) provide a more contoured flow path for the PA/PC 1 as it travels past feeder duct 9.

A flow conditioning device 30 may be used to disperse the coal to increase the rate at which it interacts with the secondary air. Flow conditioning device 30 may consist of swirl vanes and/or one or more bluff bodies to locally obstruct flow and induce swirl.

Another flow conditioning device 13 may be positioned at the end of axial pipe 6 to provide more uniform flow to secondary air as it exits axial zone 25 into burner throat 8, and out into the furnace (not shown) in the form of a center air jet. Flow conditioning device 13 can be vanes, perforated plates, or other commonly used devices to provide more uniform flow. In some cases, flow conditioning device 13 may provide swirl to the core air to further accelerate coal ignition and reduce emissions.

An aspect pertaining to the operational method of the present invention is the creation of a center air jet within with the fuel jet stream as it exits throat 8 and enters the furnace. Preferably, the center air jet will have a velocity exceeding that of the fuel jet so as to create a velocity gradient within the flame which promotes ignition of the fuel from the inside out utilizing the oxygen from the center air jet.

Optimum operating conditions occur when PA/PC exits the first annular zone at a velocity between about 3,000 ft/min and about 5,000 ft/min, and more preferably between about 3,500 ft/min and about 4,500 ft/min. Optimum operating conditions further occur when secondary air exits axial zone 25 at a velocity between about 5,000 ft/min and 10,000 ft/min, and more preferably between about 5,500 ft/min and 7,500 ft/min.

Damper 15 controls the entry of additional secondary air to the burner assembly. When in the open position damper 15 allows secondary air to flow into a second annular zone 16 concentrically surrounding first annular zone 11, wherein the second annular zone 16 is defined as the area between pipe 3B and barrel 19. Damper 15 further allows secondary air to flow into third annular zone 17 concentrically surrounding second annular zone 16, wherein the third annular zone 16 is defined as the area between barrel 19 and outside burner zone wall 38. Damper 15 can be positioned to preferentially throttle secondary air to one zone over the other, or to supply lesser quantities of secondary air to both zones. An igniter (not shown) may optionally be situated in annular zone 17, if not through pipe 6.

Optimal operating conditions for utilizing all three annular zones to provide secondary air for combustion occur when between about 20 percent and about 40 percent of the total oxygen provided to the burner by secondary air is provided through axial zone 25, more preferably between about 25 percent and 35 percent. About 10 percent to about 30 percent of the total oxygen provided to the burner by secondary air is provided through second annular zone 16, more preferably between about 15 to about 25 percent. About 40 percent to about 70 percent of the total oxygen provided to the burner by secondary air is provided through third annular air zone 17, more preferably between about 50 percent to about 65 percent.

Air flow measurement device 18 measures the secondary air flow through second annular zone 16 and third annular zone 17. Optimum operating conditions occur when secondary air exits second annular zone 16 at a velocity between about 3000 ft/min and about 4500 ft/min, more preferably between about 3100 ft/min and about 3900 ft/min. Further, wherein secondary air exits third annular zone 17 at a velocity between about 5500 ft/min and about 7500 ft/min, more preferably the velocity is between about 5700 ft/min and about 6700 ft/min.

Optimal air shear conditions generally occur when the inner diameter of the axial zone is between about 9 inches and about 20 inches, the inner diameter of the first annular zone is between about 15 inches and about 30 inches, the inner diameter of the second annular zone is between about 20 inches and about 40 inches, and wherein the inner diameter of the third annual zone is between about 22 and about 50 inches.

Adjustable vanes 21 are situated in the second annular zone 16 to provide swirled secondary air prior to exiting second annular zone 16. Other air distribution devices such as perforated plates and ramps may also be installed at the end of second annular zone 16. Fixed vanes 22A and adjustable vanes 22B impart swirl to the secondary air passing through third annular zone 17. As swirled air leaves third annular zone 17, vane 23, which may alternatively be placed in the middle of the air zone exit, deflects part of the air away from the primary combustion zone.

Figure 2:
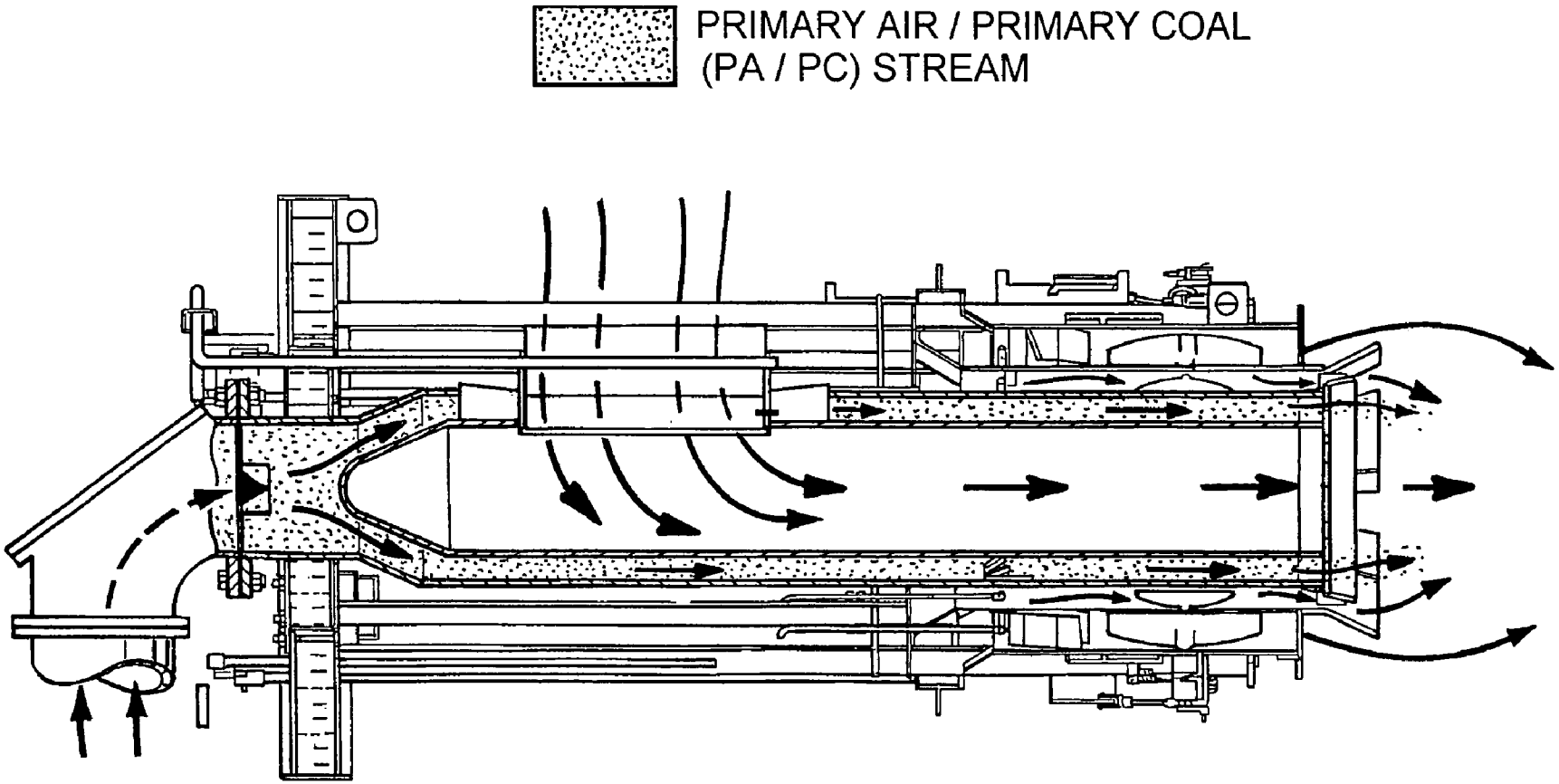
FIG. 2 is a schematic view of an embodiment of the present invention wherein arrows identify the flow paths of air and coal.

Referring now to FIG. 2, a graphical depiction, wherein arrows identify the flow paths of secondary air and PA/PC 1, is provided.

In an alternative embodiment, a gas comprising oxygen at a greater concentration than air may be utilized in place of all or part of the secondary air.

In another alternative embodiment, a hydrocarbon fuel other than pulverized coal may be utilized as fuel.

In another alternative embodiment a center conduit may be placed within axial zone 25 such that axial pipe 6 concentrically surrounds the center conduit. In such an embodiment the center conduit may house an igniter, an oil atomizer or gas alternative, or a lance for introduction of concentrated oxygen or additional hydrocarbon fuel into the flame core either axially or by radial dispersion.

In another alternative embodiment a plurality of center conduits may be placed within axial zone 25 such that axial pipe 6 concentrically surrounds each of the plurality of conduits. In such an embodiment the plurality of center conduits may provide concentrated oxygen in more than one stream, or at least one of the conduits may provide additional coal or other hydrocarbon fuel for combustion.

In another embodiment multiple feeder ducts and/or booster fans or conduits may be utilized to provide additional secondary air or oxygen to axial zone 25.

In another embodiment staged combustion is utilized with the burner and $NO_x$ reduction methods of the present invention to further reduce $NO_x$ emissions.

In yet another embodiment an alternative air ducting system may be devised wherein secondary air is ducted through outer wall 51B of windbox 51 and fed into axial zone 25 though the outer radius of an enlarged burner elbow or elsewhere to form a axial zone 25 in fluid connection with the windbox 51.

While the specific embodiments of the invention have been shown and described in detail to illustrate the application of the principles of the invention, it will be understood that the invention may be embodied otherwise as appreciated by one of ordinary skill in the art without departing from the scope of the present invention.

We claim:

1. A center air jet burner comprising:

an axial pipe defining an axial zone therein, wherein the axial pipe is plugged on one end and open on the other end, an annular pipe concentrically surrounding the axial pipe defining a first annular zone there between, a barrel concentrically surrounding the annular pipe defining a second annular zone there between, a burner zone wall concentrically surrounding the barrel defining a third annular zone there between, a feeder duct radially interposed between the axial pipe and the annular pipe, wherein the feeder duct provides fluid communication between the axial zone and a windbox, a means for conditioning a pulverized coal flow around a portion of the feeder duct contained in the first annular zone, and a flow regulating damper in the feeder duct.

2. A burner as recited in claim 1, wherein the axial zone contains a flow conditioning device.

3. A burner as recited in claim 1, wherein the first annular zone contains a flow conditioning device.

4. A burner as recited in claim 2, wherein the first annular zone contains a deflector upstream of the axial pipes plugged end.

5. A burner as recited in claim 3, further comprising a means for providing the first annular zone with a pulverized coal.

6. A burner as recited in claim 3, wherein the second annular zone and the third annular zone are in fluid communication with the windbox.

7. A burner as recited in claim 6, further comprising a vane in the second annular zone.

8. A burner as recited in claim 7, further comprising a vane in the third annular zone.

9. A burner as recited in claim 7, further comprising an air flow measuring device and a damper in the second and third annular zones.

10. A burner as recited in claim 1, further comprising a conduit concentrically surrounded by the axial zone.

11. A burner as recited in claim 1, wherein the diameter of the axial zone is between about 9 inches and about 20 inches and the diameter of the first annular zone is between about 15 inches and 30 inches.

12. A burner as recited in claim 11, wherein the diameter of the second annular zone is between about 20 inches to about 40 inches.

13. A burner as recited in claim 12, wherein the diameter of the third annular zone is between about 22 inches to about 50 inches.

14. A burner as recited in claim 13, further comprising a conduit concentrically surrounded by the axial zone.

15. A method of reducing NOx emissions in a center air jet burner comprising the steps of;

providing a four zone burner, wherein the innermost zone is an axial zone concentrically surrounded by a first annular zone, and the first annular zone is concentrically surrounded by a second annular zone, and the second annular zone is concentrically surrounded by a third annular zone;

providing a windbox in fluid communication with the axial zone, the second annular zone, and the third annular zone;

supplying the windbox with a secondary air;

providing the first annular zone with a carrier gas comprising a pulverized coal;

discharging the the carrier gas from the first annular zone at a velocity greater than about 3000 ft/min;

producing a flame by combusting the discharged pulverized coal with the secondary air discharged from the second and third annular zones;

creating a secondary air pocket in the core of the flame by discharging the secondary air provided to the axial zone at a velocity significantly greater than the carrier gas, combusting the flame from the inside with the secondary air contained in the secondary air pocket, creating a internal recirculation zone by discharging the secondary air provided to the second annular zone at a velocity less than the carrier gas and by discharging secondary air provided to the third annular zone at a velocity greater than the carrier gas; and suppressing NOx emission by recirculating uncombusted coal, oxygen and NOx radicals into the flame.

16. The method as recited in claim 15, further comprising swirling the secondary air discharged from the second annular zone.

17. The method as recited in claim 15, further comprising swirling the carrier gas discharged from the first annular zone.

18. The method as recited in claim 16, further comprising swirling the secondary air discharged from the third annular zone.

19. The method as recited in claim 18, further comprising swirling the secondary air discharged from the axial zone.

20. A method of reducing NOx emissions in a center air jet pulverized coal burner comprising the steps of;

providing a burner having an axial zone concentrically surrounded by a first annular zone, a second annular zone concentrically surrounding the first annular zone and a third annular zone concentrically surrounding the second annular zone;

providing the axial zone with a first gas comprising oxygen, wherein the first gas exits the axial zone at a velocity between about 5000 ft/min and about 10,000 ft/min;

providing the first annular zone with a carrier gas comprising a pulverized coal, wherein the carrier gas exits the first annular zone at a velocity between about 3000 ft/min and about 5000 ft/min providing the burner with a second gas comprising oxygen, wherein the second gas exits the second annular zone at a velocity between about 3000 ft/min and about 4500 ft/min, and providing the burner with a third gas comprising oxygen, wherein the third gas exits the third annular zone at a velocity between about 5500 ft/min and about 7500 ft/min.

21. The method as recited in claim 20, wherein the first gas exits the axial zone at a velocity between about 5500 ft/min and 7500 ft/min, and wherein the carrier gas exits the first annular zone at a velocity between about 3500 ft/min and 4500 ft/min.

22. The method as recited in claim 21, wherein the second gas exits the second annular zone at a velocity between about 3100 ft/min and about 3900 ft/min, and wherein the third gas exits the third annular zone at a velocity between about 5700 ft/min and about 6700 ft/min.

23. The method as recited in claim 21, further comprising the step of providing a burner flame with oxygen wherein about 20 percent to about 40 percent of the total oxygen is provided by the first gas through the axial zone, about 10 percent to about 30 percent of the total oxygen is provided by the second gas through the second annular zone, and about 40 percent to about 70 percent of the oxygen is provided by the third gas through the third annular zone.

24. The method as recited in claim 23, further comprising the step of swirling at least one of the group consisting of the first gas, the second gas, the third gas, and the carrier gas prior to reaching the burner flame.

25. The method as recited in claim 23, further comprising the steps of; combusting the pulverized coal in the carrier gas stream from the inside of the stream with the first gas, combusting the pulverized coal in the carrier gas stream from the outside with the second gas and the third gas;

providing a means for creating a recirculation zone within the burner flame; and suppressing NOx formation and accelerating combustion by recirculation of uncombusted coal and oxygen in the burner flame.

26. The method as recited in claim 23, further comprising the step of utilizing a flow conditioning means for conditioning gas flow within at least one of the group consisting of the axial zone, the first annular zone, the second annular zone, and the third annular zone.

* * * * *